US006880491B2

(12) United States Patent
Reiner et al.

(10) Patent No.: US 6,880,491 B2
(45) Date of Patent: Apr. 19, 2005

(54) METHOD AND APPARATUS FOR GENERATING SUPERHEATED STEAM

(75) Inventors: David Reiner, Haifa (IL); Ben Zion Freedman, Hamovil (IL)

(73) Assignee: Rafael Armament Development Authority Ltd., Haifa (IL)

( * ) Notice: Subject to any disclaimer, the term of this patent is extended or adjusted under 35 U.S.C. 154(b) by 342 days.

(21) Appl. No.: 10/184,131

(22) Filed: Jun. 26, 2002

(65) Prior Publication Data

US 2003/0017428 A1 Jan. 23, 2003

(30) Foreign Application Priority Data

Jul. 2, 2001 (IL) ..... 144109

(51) Int. Cl.[7] ..... B09B 3/00; F23J 7/00
(52) U.S. Cl. ..... 122/4 R; 431/4
(58) Field of Search ..... 122/4 R, 482; 502/241, 344; 431/1, 4; 429/12, 13, 19

(56) References Cited

U.S. PATENT DOCUMENTS

| | | | | | |
|---|---|---|---|---|---|
| 3,779,212 | A | * | 12/1973 | Wagner | 122/23 |
| 3,879,680 | A | | 4/1975 | Naismith et al. | |
| 4,193,879 | A | * | 3/1980 | Leach | 422/186.3 |
| 4,967,840 | A | * | 11/1990 | Miller | 166/303 |
| 5,711,146 | A | | 1/1998 | Armstrong et al. | |
| H1948 | H | * | 3/2001 | Rusek et al. | 502/344 |
| 6,255,009 | B1 | * | 7/2001 | Rusek et al. | 429/13 |

* cited by examiner

*Primary Examiner*—Gregory Wilson
(74) *Attorney, Agent, or Firm*—Merchant & Gould P.C.

(57) ABSTRACT

Method and apparatus for generating superheated steam from industrial grade hydrogen peroxide. Hydrogen peroxide and a combustible fluid are injected into a first part of the combustion chamber to form a reactant mixture. The reactant mixture is ignited, to allow for the decomposition of hydrogen peroxide and the generation of superheated steam, which exits from a second part of the combustion chamber. An improved combustion efficiency is realized with the implementation of a flame holder.

37 Claims, 8 Drawing Sheets

METHOD AND APPARATUS FOR GENERATING SUPERHEATED STEAM

FIELD OF THE INVENTION

The present invention relates to the field of high-energy lasers. More particularly, the invention relates to a method and apparatus for generating superheated steam, so that a vacuum is produced around the laser cavity, by means of combustion the oxidant of which is supplied by the thermal decomposition of hydrogen peroxide.

BACKGROUND OF THE INVENTION

Superheated steam, produced by the addition of heat after evaporation, is widely used in power generation due to the increased thermodynamic efficiency and also due to the prevention of heat loss and damage to components, such as turbine blades, that would have resulted from condensation. Recently other industrial applications for superheated steam have been established, including the cleaning and food processing industries. As a result of pressurized superheated vapor, an improved cleaning action may be effected by weakening the bond between contaminants and the associated surfaces.

While not limited thereto, the present invention introduces a novel method to generate superheated steam. The intensity of the generated superheated steam, i.e. its pressure, temperature and velocity, enables the usage thereof for the operation of a steam ejector to be used in a high-energy chemical laser system.

In a chemical laser, a steady stream of population-inverted active molecules is produced dun the course of a exothermic chemical reaction. Many chemical lasers require mechanical pumps and rotary blowers to compress the working gases and diluents found in the opt cavity to ambient pressure for discharge. U.S. Pat. No. 8,879,680 issued to Naismith et al precludes the need for such expensive equipment and discloses a high velocity jet of gaseous combustion products which is injected into a low pressure chemical laser system The high velocity jet provides an aspirator action which pumps the low pressure gaseous effluent from the optical cavity and is entrained therein. Insofar as this method requires a steady stream of high-velocity hot steam or gas in order to provide the energy needed to evacuate the gaseous by-products that are generated during the chemical laser operation, there are a few ways to achieve the desired fluid mass flow rate:

a) Compressed Gas. Compressed gas stored within containers is provided with a sufficient amount of kinetic energy when expanded to ambient pressure so as to entrain the chemical laser effluent. This method requires large storage volume.
b) Flash Evaporation. Hot water stored with a container at a high pressure is converted to steam by flash evaporation. This method also requires a large system volume, and additionally, requires a long response time from boiler startup until steam generation.
c) Conventional Steam Generator: Hydrocarbon fuels are combustible with air, releasing heat at a sufficiently rapid rate to thereby generate steam This method is slow, and requires a large steam generation facility.
d) Catalytic Conversion of Hydrogen Peroxide. Catalysts are used to decompose hydrogen peroxide into steam and oxygen. This method is effective, but requires a special grade of hydrogen peroxide having a relatively high concentration and a relatively small amount of stabilizers to prevent catalyst poisoning, i.e. the generation of a coating an the catalyst which would disable decomposition In addition to steam, a large amount of oxygen is produced. Oxygen reacts with some of the laser by-products of deuterium and hydrogen, thereby generating excessive heat and resulting in thermal choking within the suction chamber of the ejector that reduces the performance thereof. Furthermore, the oxygen is not utilized for secondary combustion, and the efficiency of the process is therefore necessarily lowered.

Attempts have been made to produce steam from the decomposition of hydrogen peroxide and to utilize its relatively high energy density. Catalysts such as solid silver catalysts have been used to promote the decomposition of hydrogen peroxide to yield not just steam, but also oxygen, which is combustible with alcohol based fuels such as methanol or ethanol. These silver catalysts have the disadvantage of having only a relatively short effective life due to the rapid loss of silver, and have to be replaced approximately every 15 minutes of operation to ensure complete decomposition and quick response. U.S. Pat. No. 5,711,146 discloses a new type of catalyst consisting of a mixture of ruthenium with iridium and/or platinum. In addition to the high costs associated therewith, the disadvantages of using catalysts for steam production include a need for a special grade of hydrogen peroxide that contains a small amount of stabilizers. Furthermore, high-grade hydrogen peroxide presents a short storage life.

All the methods described above have not yet provided satisfactory solutions to the production of superheated steam from hydrogen peroxide.

It is an object of the present invention to provide a method and system for the production of superheated steam from hydrogen peroxide which does not require the use of a catalyst.

It is another object of the present invention to provide a method and system for the production of superheated steam from industrial grade hydrogen peroxide that does not require the removal of stabilizers therefrom.

It is yet another object of the present invention to provide a method and system for the production of superheated steam from hydrogen peroxide that does not present a safety hazard.

It is still another object of the present invention to provide a method and system for the cost-effective production of superheated steam.

It is a further object of the present invention to provide a method and system for the production of a relatively large amount of superheated steam.

It is a further object of the present invention to provide a method and system for the production of superheated steam within a short response time.

It is a further object of the present invention to provide a method and system for the production of superheated steam which allows for the entrainment of the gaseous effluent from the optical cavity of a chemical laser without resulting in thermal choking within the ejector.

Other objects and advantages of the invention will become apparent as the description proceeds.

SUMMARY OF THE INVENTION

The present invention relates to a method of generating superheated steam from industrial grade hydrogen peroxide, comprising the steps of injecting hydrogen peroxide and a combustible fluid into a first part of a combustion chamber to form a reactant mixture, igniting said reactant mixture whereby to produce combustion gases and to generate superheated steam.

Preferably, the method further comprises the step of allowing generated superheated steam to exit from a second part of the combustion chamber while inducing vertices in said second part of the combustion chamber.

Ignition of said reactant mixture is preferably initiated by means of a pilot flame hydrogen peroxide and the combustible fluid are preferably injected into the combustion chamber only when the pilot flame is lit.

An advantage of the method of the invention is that commercial hydrogen peroxide can be used with a concentration as low as 49%, and even less, thereby minimizing safety hazards. An additional advantage of this method is that a relatively small steam generation unit may be utilized. Furthermore, a stream of superheated steam can be provided in a short response time. With the use of the method of the present invention, the gaseous effluent may be entrained from the optical cavity of a chemical laser within less than 1.0 second.

The present invention also relates to an apparatus for the generation of superheated steam from industrial hydrogen peroxide, comprising:

a) a combustion chamber;
b) a flame holder mounted within the combustion chamber and dividing the same into a first and second part;
c) a first shutoff valve for the injection of hydrogen peroxide into said first part of said combustion chamber;
d) a second shutoff valve for the injection of a combustible fluid into said first part of said combustion chamber;
e) a means for the ignition of a pilot flame; and
f) an exit nozzle for the release of the generated superheated steam from said second part of said combustion chamber.

A flame holder, a referred to herein, is defined as an element that is permeable to combustion gases and is made of a fire resistant material, and has such a structure so as to induce vortices within the combustion gases beyond said element. The flame holder, due to its unique operation, creates zones of low speed flow and stagnation points in its wake. Within these zones, the flame does not continue downstream, and flame nuclei are produced which ignite the combustion gases that flow adjacent to these zones. The flame holder, which functions as a source of hot spots to induce evaporation of hydrogen peroxide droplets and decomposition of hydrogen peroxide vapor as a result of being heated by the pilot flame, preferably has a low thermal mass to shorten the required time or hot spot formation, and consequently, the delay time between pilot ignition and injection of hydrogen peroxide into the combustion chamber. Examples of a flame holder include a ring interposed between two screens, concentric rings having a V-shaped or H-shaped cross-section, and a cross-shaped configuration having a V-shaped or H-shaped cross-section.

BRIEF DESCRIPTION OF THE DRAWINGS

The above and other characteristics and advantages of the invention will be better understood through the following illustrative and non-limitative detailed description of preferred embodiments thereof, with reference to the appended drawings, wherein.

DETAILED DESCRIPTION OF PREFERRED EMBODIMENTS

Figure 1:
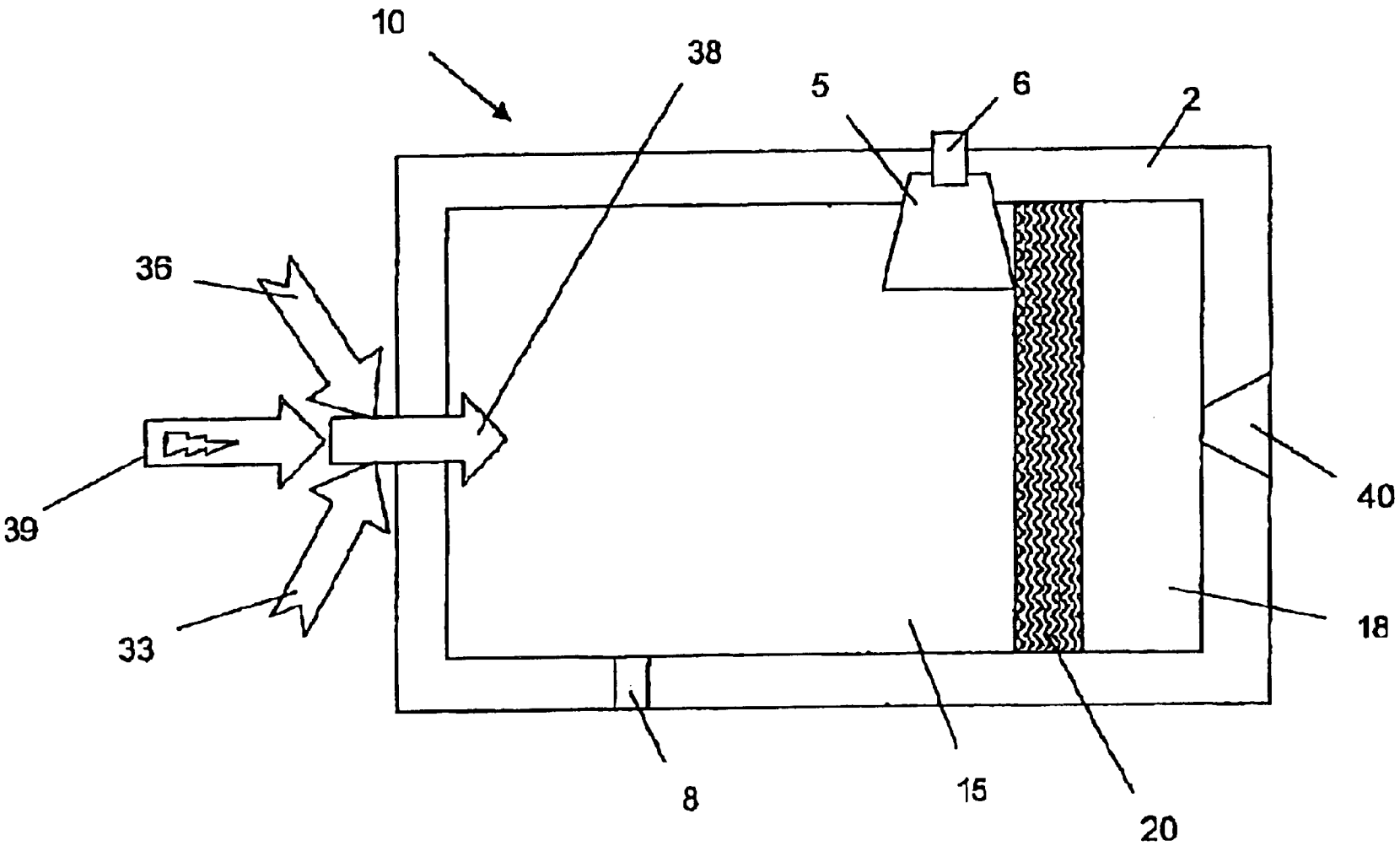
FIG. 1 is a schematic drawing of a cross-sectional view of a combustion chamber.

FIG. 1 is a cross-sectional view of a combustion chamber generally designated at 10 in which superheated steam is generated Combustion chamber 10 includes flame holder 20, which divides the combustion chamber into a first or upstream part 15 and a second or downstream part 18, and which is schematically shown in the figure. Said upstream part of said chamber may be called "inlet chambers" and said downstream part may be called "vortex chamber." Preferably, peripheral wall 2 of the combustion chamber has a cylindrical shape and is made of stainless steel Combustion chamber 10 has a minimum length between 150 mm and 1500 mm, e.g. at least 300 mm, and an inner diameter between 50 and 250 mm., e.g. 50 mm.

Superheated steam can be generated within combustion chamber 10 at any preferred mass flow rate, e.g. ranging from fractions of a gram per second to an order of kilograms per second, depending on the amount of hydrogen peroxide injected therein. The temperature of the combustible reactant mixture which generates the superheated steam ranges from 500° C. to 1400° C., with a temperature gradient extent both radially and axially, when the combustion chamber has a cylindrical configuration For example, the temperature of the reactant mixture may reach 900° C. in inlet chamber 15, while its temperature may reach 1200° C. in vortex chamber 18. The inner wall(s) of inlet chamber 15 and vortex chamber 18 have a temperature of approximately 800° C., depending primarily on the time of ignition. The temperature of the reactant mixture at exit nozzle 40 is dependent mainly on the fuel/oxygen ratio, and is controllable by varying the ratio between the hydrogen peroxide and the fuel. For example, if hydrogen peroxide solution, which is provided with a concentration of 50% and a flow rate of 600 g/s, is burned with a fuel having a flow rate of 30 g/s, the temperature of the reactant mixture will be 1200° C.

Flame holder 20, a device as defined hereinbefore, enhances the generation of superheated steam. By inducing vortices within the combustion gases downstream of the flame holder, blow-off is precluded and flame stabilization is achieved as a result of improved mixing of the unburned portion of the reactant mixture. Consequently an improved combustion efficiency may be realized.

Any flame holder may be employed that stabilizes the flame produced from the combustion gases and forms hot spots after ignition of the pilot flame. The flame holder is preferably made from a material such as a screen or sheet metal that has a low thermal mass, i.e. has low thermal conductivity yet is able to absorb large heat influx to thereby rapidly increase in temperature, to shorten the required time for hot spot formation, and consequently, the delay to between pilot ignition and injection of hydrogen peroxide into the combustion chamber, as will be described hereinafter. The flame holder is positioned in such a fashion so as to receive a sufficient amount of heat influx from the pilot flame.

Figure 2:
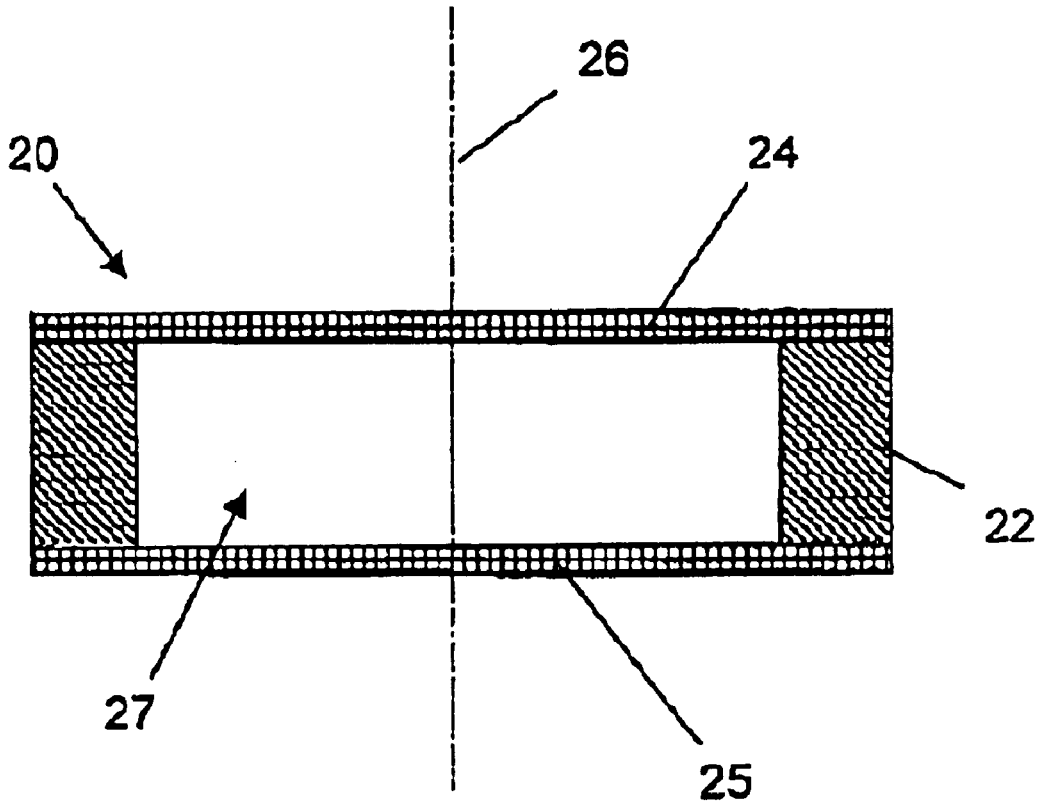
FIG. 2 is a schematic draw of a cross-sectional view of a flame holder according to a preferred embodiment of the invention.

Flame holder 20, shown in detail in FIG. 2, can be of any suitable transverse shape corresponding to that of the combustion chamber, and is conveniently circular when a tubular combustion chamber is employed. In one embodiment, flame holder 20 is comprised of ring 22 interposed between first screen 24 and second screen 25, thereby forming cavity 27 between screens 24 and 25. Ring 22 and screens 24 and 25 are preferably made from stainless steel. Flame holder 20 is fixedly mounted within combustion chamber 10 (FIG. 1), such that central axis 26 of ring 22 is parallel to the longitudinal axis of the combustion chamber. Flame holder 20 may be adapted to span the entire diameter of combustion chamber 10, or any portion thereof. The ratio between the width of flame holder 20 and the length of combustion chamber 10 is typically 1:6, and ranges e.g. from 1:10 to 1:5. The ratio between the inner diameter of ring 22 and combustion chamber 10 ranges between 1:1 and 1:3.

A plurality of flame holder configurations are described in "Altitude Investigation of 16 Flame-Holder and Fuel-System Configurations in Tail-Pipe Burner," Ralph E. Grey et al, National Advisory Committee for Aeronautics, Washington, 1951, the contents of which are incorporated herein by reference.

Figure 3:
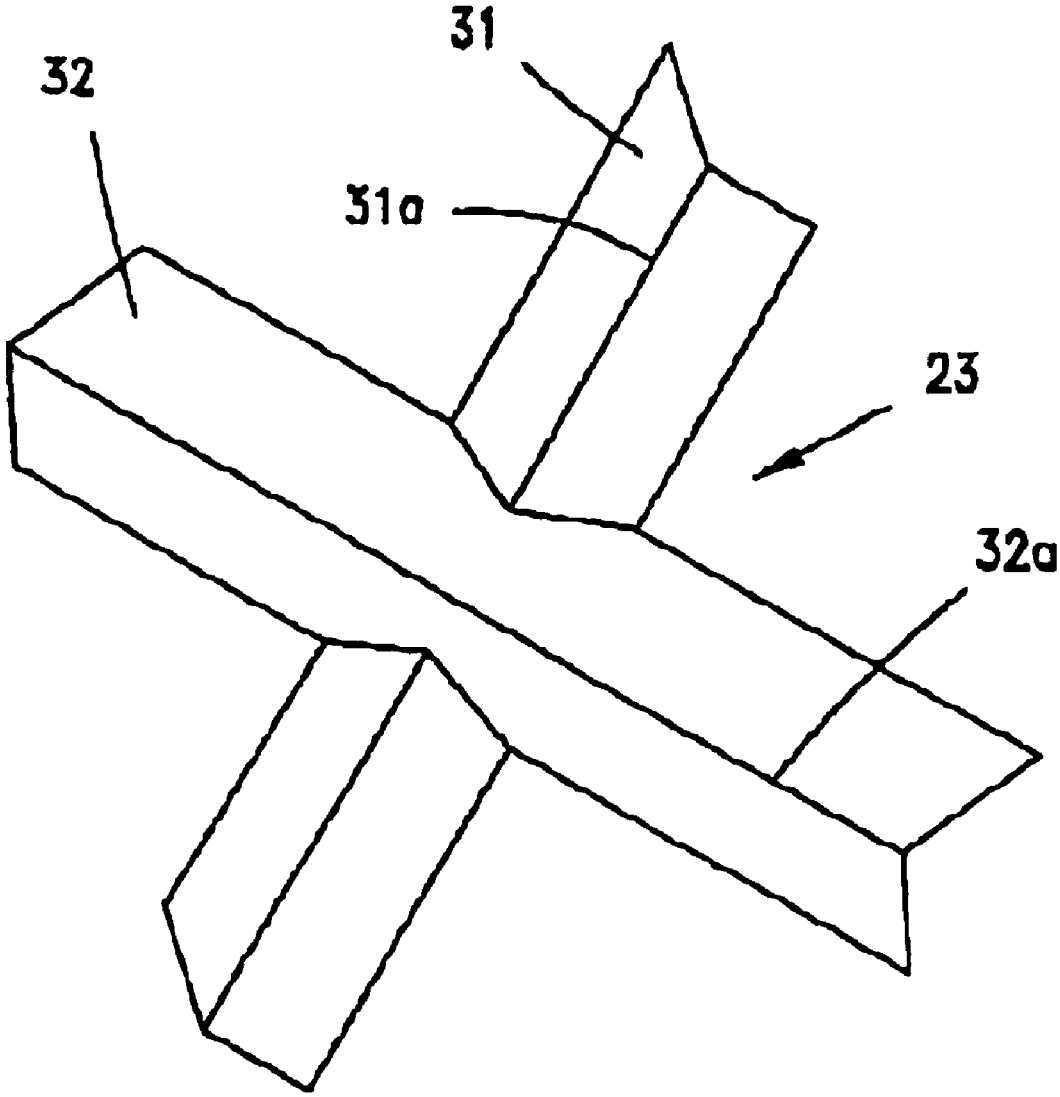
FIG. 3 is a perspective view of a flame holder according to a second preferred embodiment.
Figure 4B:
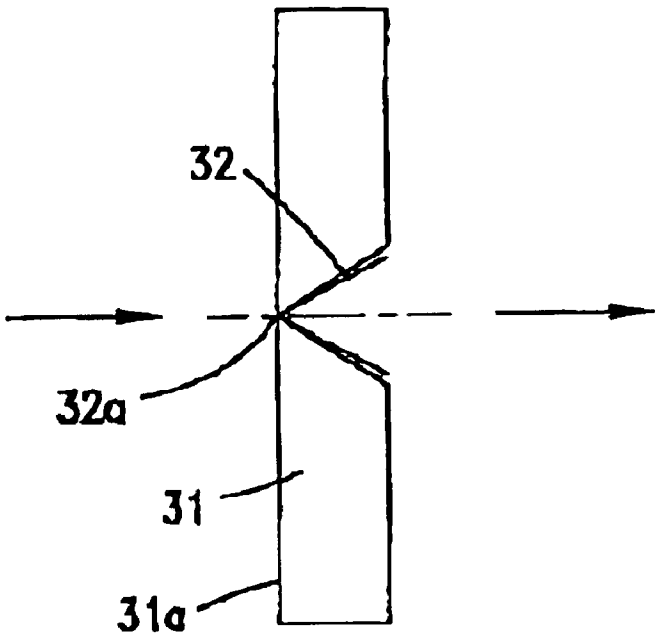
FIG. 4A is a plan view and FIG. 4B is a side view of a flame holder according to a second preferred embodiment.
Figure 4A:
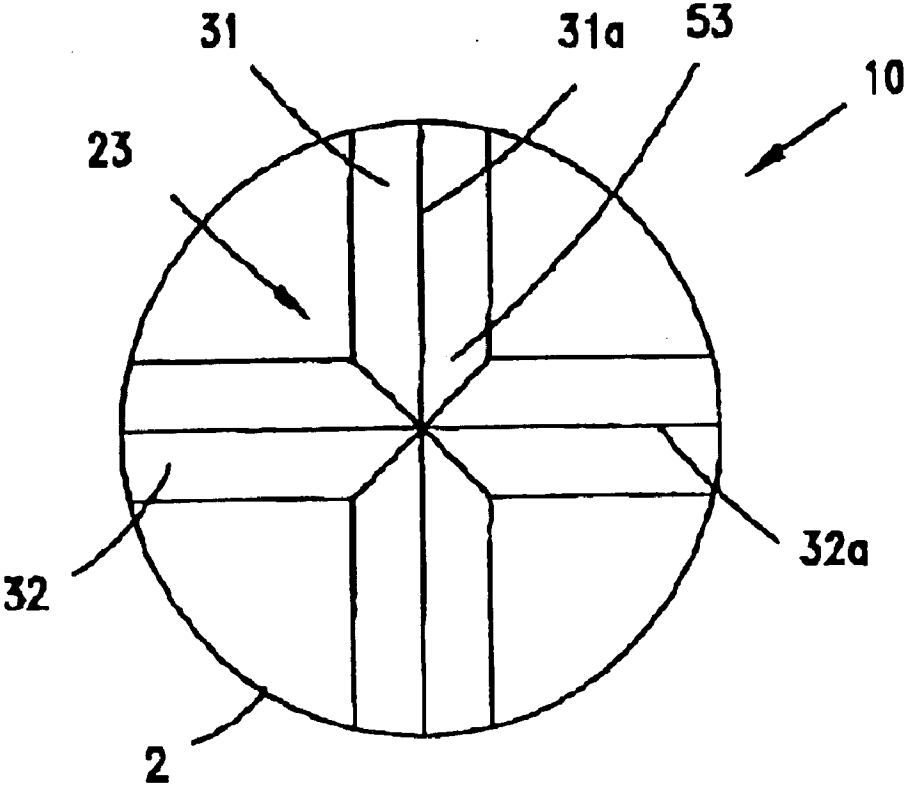

Another embodiment of a flame holder is shown in FIGS. 3 and 4. Flame holder 23 is comprised of two intersecting and rigidly connected elements 31 and 82, which form a cross-like configuration in plan view. Edges 31*a* and 32*a* of elements 31 and 32, respectively, may be, but are not necessarily, coplanar FIG. 3 illustrates an example in which edges 31*a* and 32*a* are not coplanar. FIG. 4 illustrates an example in which edges 31*a* and 32*a* are coplanar A plan view of the elements is shown in FIG. 4A while a side view of the elements is shown in FIG. 4B. Each element spans the diameter, or a portion thereof, of combustion chamber 10 and is provided with a V-shaped cross section having such a configuration that each inclined side of an element is intersected by the other element to form a V-shaped notch in the corresponding side. Edges 31*a* and 32*a* face upstream, and the open end of the elements point downstream, i.e. facing the exit nozzle, as indicated by the direction of the illustrated arrows.

Similarly elements 31 and 32 may have an H-shaped cross section, or any other shape that induces vertices downstream of the flame holder. In an element having an H-shaped cross section, a cross member connecting the two logs of each element is curved.

Figure 5C:
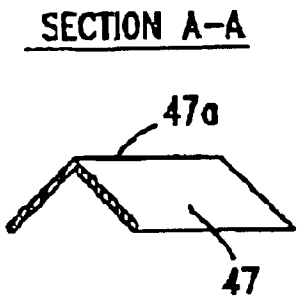
FIG. 5B is a side view and FIG. 5C is a perspective cross sectional view cut at plane A—A of FIG. 5A of a third preferred embodiment of a flame holder.
Figure 5B:
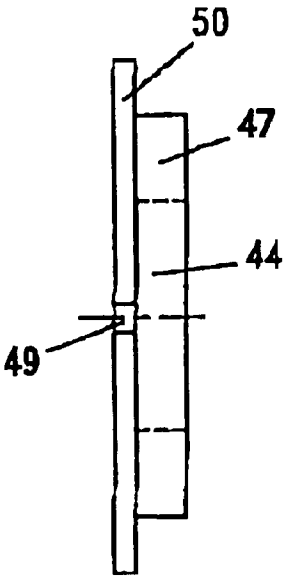
Figure 5A:
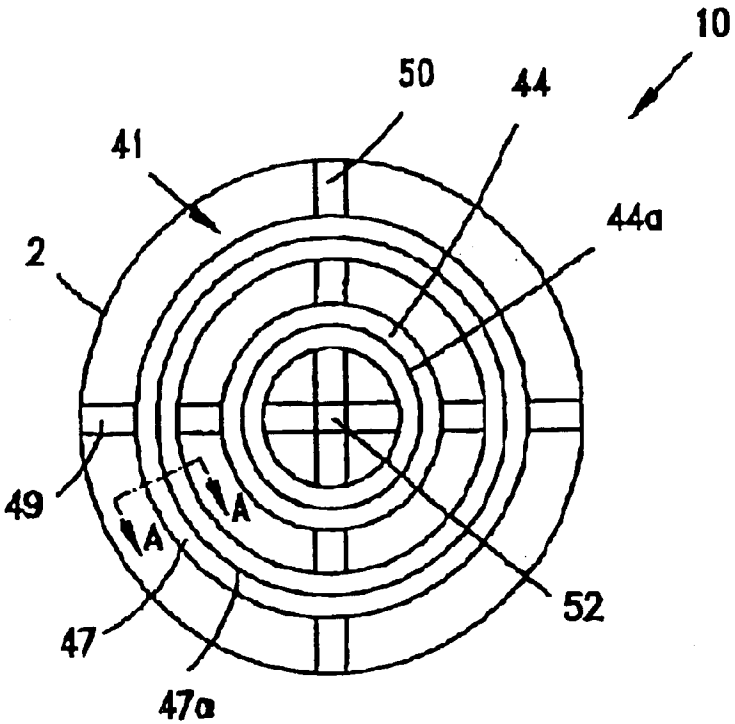
FIG. 5A is a plan view.

A third embodiment of a flame holder is shown in FIG. 5. Flame holder 41 is comprised of two concentric rings 44 and 47 shown in plan view in FIG. 5A. As shown in FIG. 5B, central edges 44*a* and 47*a* of rings 44 and 47, respectively, are coplanar, or alternatively, may be separated along the length of combustion chamber 10 (not shown). These rings, which are interconnected by means of cross members 49 and 50 to peripheral wall 2 of the combustion chamber, may be provided with a V-shaped cross section as shown in FIG. 5C, or alternatively may be provided with an H-shaped cross section (not shown). When rings 44 and 47 are not coplanar, cross member 50 is curvilinear and slopes from one ring to the other before being affixed to peripheral wall 2 of the combustion chamber. Cross members 49 and 50 are connected at intersection 52.

EXAMPLE I

Figure 6:
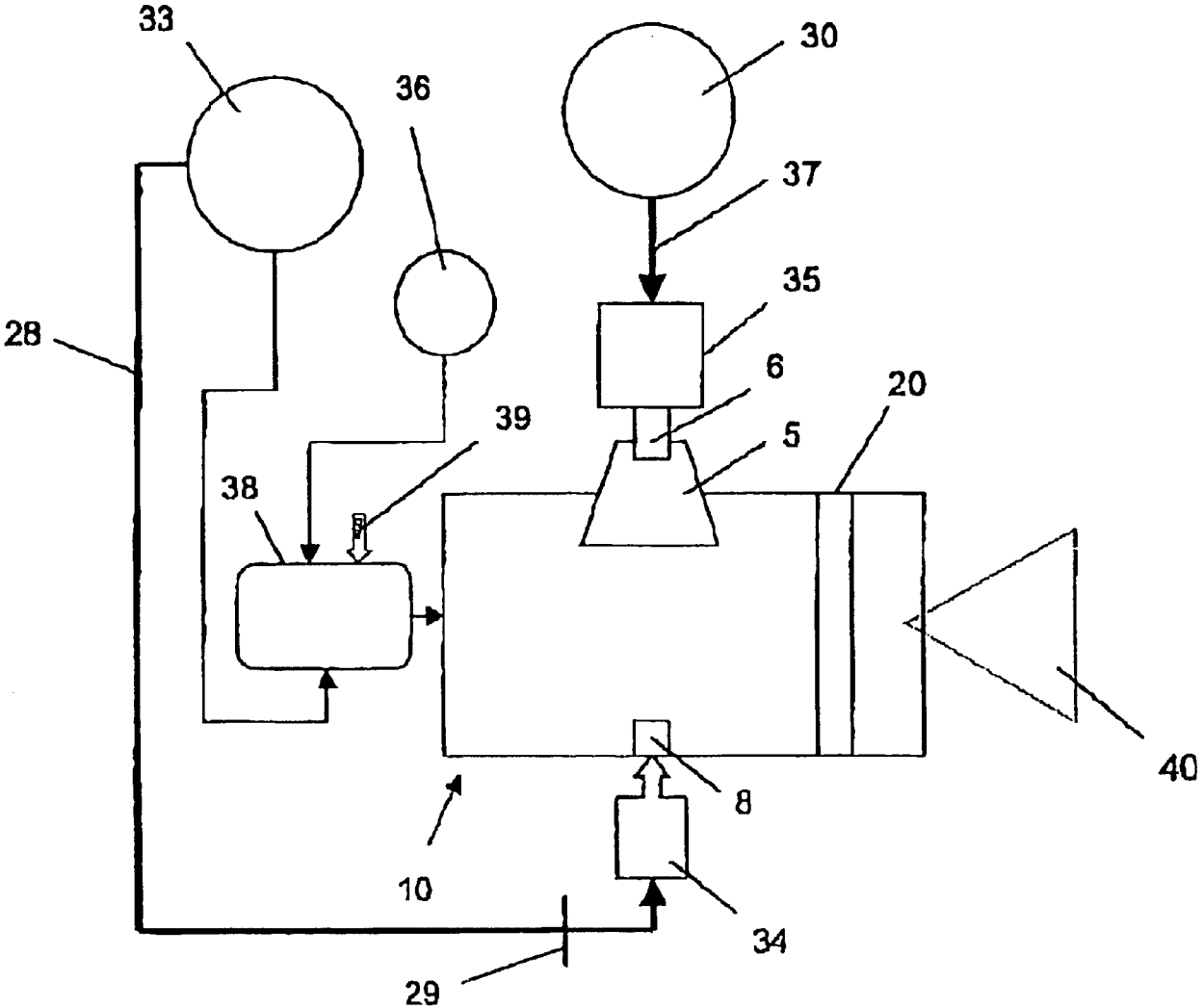
FIG. 6 is a schematic drawing of a steam generator.

Referring now to FIG. 6, which is an illustrative example of operation, hydrogen peroxide aqueous solution 30 flowing through conduit 37, having a concentration ranging from 49% to 70% and containing at least 200 mg/liter or stabilizers, is injected into combustion chamber 10 through first shutoff valve 6 at a pressure of 2.0 MPa, at a temperature of 20° C., at a flow rate of 1000 g/s, and is atomized through nozzle 5. Ethylene 33, or any other combustible fluid, is injected through second shutoff valve 8 at a temperature of 20° C., and at a flow rate of 40 g/s. Ethylene flows through tube 28 into combustion chamber 10. Disk 29 is fixedly attached to tube 28, and is formed with an aperture (not shown) so that the flow of ethylene 38, which passes therethrough, is restricted The aperture typically has a diameter of approximately 2.0 mm. Hydrogen peroxide and ethylene are provided at a ratio of 1:20 (for hydrogen peroxide solution at a concentration of 49%), and are mixed at the inlet part of the combustion chamber. A homogeneous reactant mixture is produced as a result of the mixing of the atomized liquid hydrogen peroxide droplets with the gaseous ethylene parties before reaching the hot flame holder, as will be hereinafter described. Controllers 34 and 35 we provided to ensure that the values of the pressure, temperature and flow rate of both ethylene and hydrogen peroxide do not deviate from the predetermined values by more than 15%, to prevent blow-off and flash-back. A flame is blown away when the supply velocity of the reactant mixture exceeds the flame speed, and flashes back into the combustion chamber if the supply velocity is too small.

Ignition of the reactant mixture is preferably initiated by means of a pilot flame. The pilot flame is electrically ignited with spark plug 39, or with any other ignition means, after ethylene 33 and oxygen 36 are supplied to pilot chamber 38. The oxygen and ethylene inlet pressure is 1 MPa. The oxygen is supplied to the pilot chamber through a 1.0 mm orifice and the ethylene through a 0.8 mm orifice. The mixture ratio is 1:2, with 1.0 g/sec ethylene and 2.0 g/sec oxygen. The pilot flame functions not just as an economic means of initiating combustion, but also as a means of initiating the decomposition of hydrogen peroxide. The gaseous jet stream generated by the pilot flame having a temperature of approximately 2400° C. impinges the atomized hydrogen peroxide droplets, whereby the latter are decomposed into water and oxygen as a result of the relatively high influx of heat produced by the pilot flame. A flame detection system (not shown) detects tie presence of the pilot flame, and activates a relays witch, which in turn keeps the respective shutoff valves open. If the flame detection system detects that the pilot flame has been extinguished, the shutoff valves will close. This is performed in a manner well known to those skilled in the art, to prevent uncontrolled flame propagation. The pilot flame is ignited for a short period of time, up to 4 sec, then is extinguished. The combustion is then self-sustaining.

Figure 7:
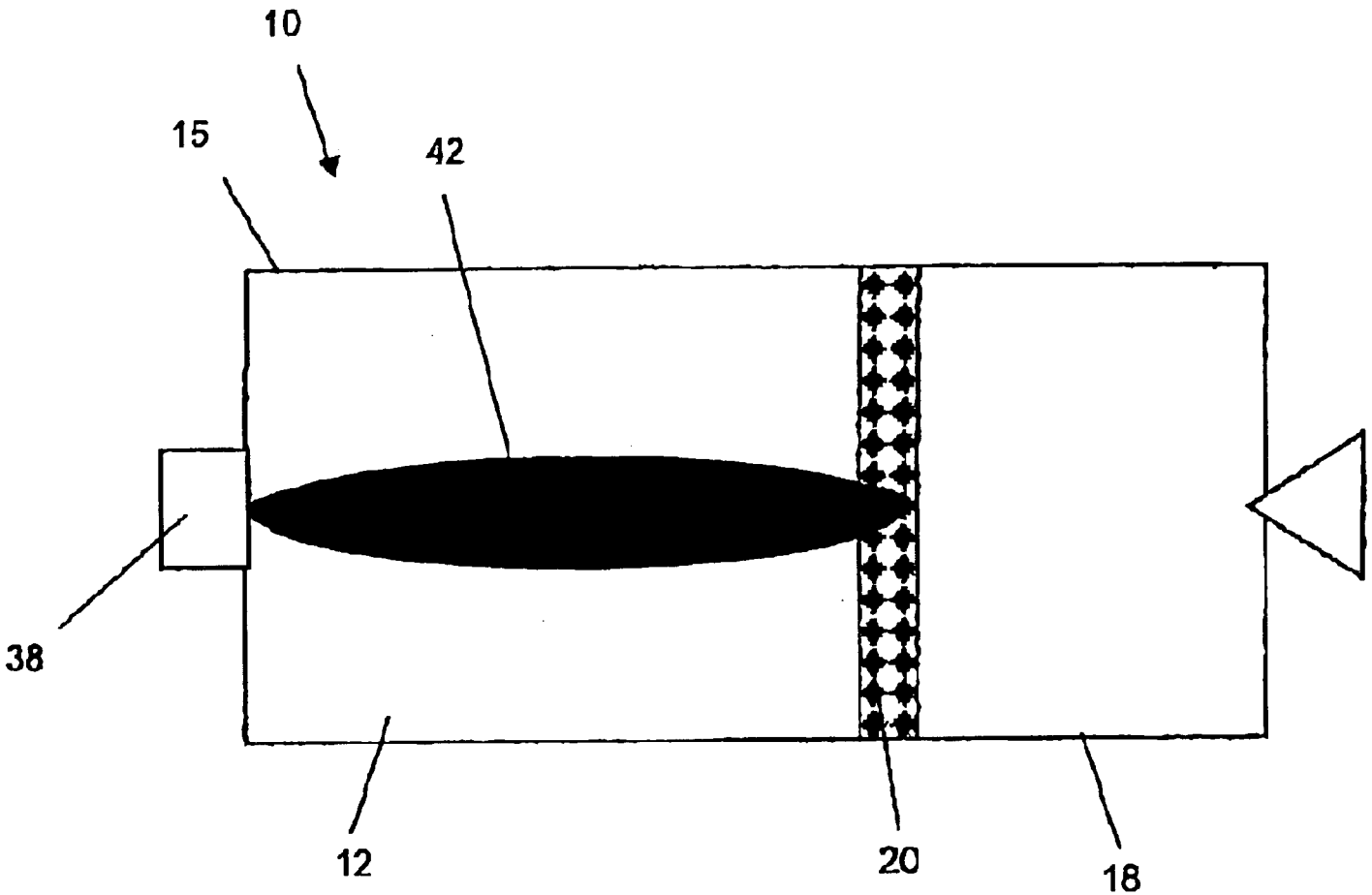
FIG. 7 is a schematic drawing of the combustion chamber showing the propagation of the pilot flame.

Operationally, the pilot flame is ignited at pilot chamber 38 1.0–2.0 seconds before hydrogen peroxide 30 and ethylene 33 are injected into combustion chamber 10. As shown in FIG. 7, pilot flame 42 heats interior 12 of inlet chamber 15. The long pilot flame then heats first screen 24 and second screen 25 (FIG. 2) of flame holder 20, thereby forming hot spots thereon. Hydrogen peroxide, after being introduced into inlet chamber 15, begins decomposing as a result of the high temperature of interior 12. The hot spots formed on flame holder 20 help to increase the rate of heat decomposition of the hydrogen peroxide and to contribute to the ignition of the reactant mixture. Upon reaching the flash point of at least 900° C., the reactant mixture flashes and a weak flame propagates throughout inlet chamber 15. The pilot flame is in contact with the reactant mixture until the fire point of the latter is achieved, a temperature of at least 1200° C. Following ignition, surface evaporation and combustion continue one after the other, whereby the liquid surface of the reactant mixture receives heat from the combustion flame, vaporizes and burns. When a steady state is established, e.g. 250 msec after the injection of hydrogen peroxide 30 and ethylene 33 into combustion chamber 10, at which a maximum temperature and a stable pressure are achieved, the rate of vaporization is equal to the rate of burning. Pilot flame 42 continues to be lit for approximately an additional 1.75 seconds to assure the continuation of the combustion process.

Figure 8:
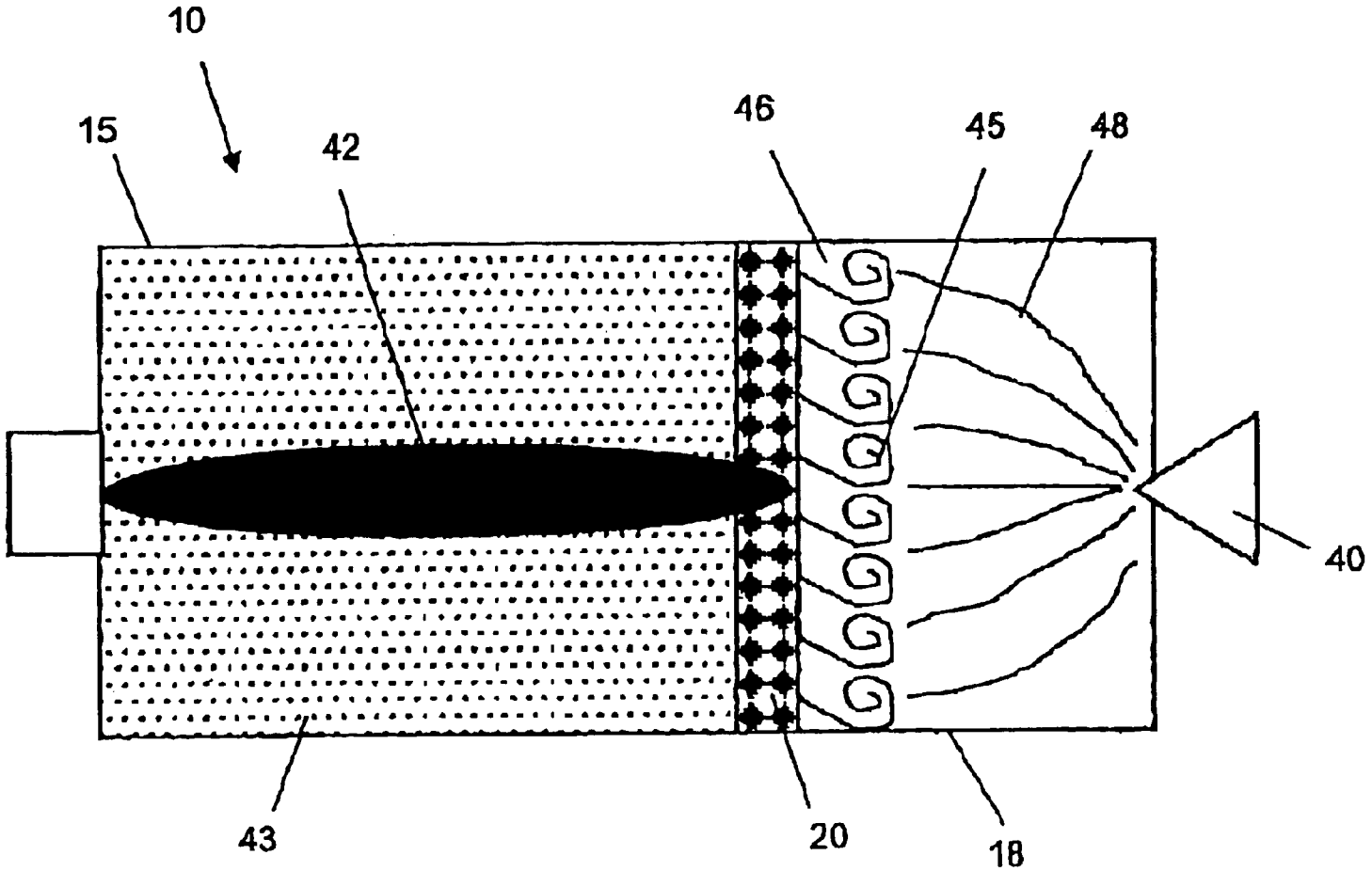
FIG. 8 is a schematic drawing of the combustion chamber showing the conditions of combustion.

To increase the rate of heat transfer and the corresponding release of high-density energy associated with hydrogen peroxide, flame holder 20 (FIG. 2) is used. The flame holder functions as follows After hydrogen peroxide and ethylene are injected into the chamber, hydrogen peroxide starts to decompose. Ethylene and the decomposition product oxygen react exothermally in conjunction with the hot spots and start burning. As shown in FIG. 8, the unburned portion of reactant 43, as well as the combustion products, passes through the flame holder, through screen 24, increasing turbulence within cavity 27 and inducing vortices 45 at combustion zone 46 within vortex chamber 18. Vortices 45 increase the contact surface between the unburned portion of the reactant mixture, and consequently the combustion efficiency. The conditions are therefore created that permit completion of the reaction in vortex chamber 18 of the combustion chamber by attaining an optimal fuel/oxidant ratio between the reactants oxygen, produced as a result of the decomposition of hydrogen peroxide, and ethylene. Reactant mixture 43 produces the combustion product of $CO_2$ and superheated steam at a temperature of 1200° C. and a pressure of 1.5 MPa. The superheated steam, as indicated by streamlines 48, is released through exit nozzle 40 at a velocity of 1500 m/s as a result of the pressure differential between vortex chamber 18 and the exterior of combustion chamber 10.

The superheated steam may be directed to the ejector (not shown) of a high-energy chemical laser, and constitutes the motive fluid thereof. An ejector is well known to those skilled in the art, and for brevity needs not to be described. Due to the high kinetic energy associated with the generated superheated steam, a vacuum on the order of 10 torr is produced in the vicinity of the optical cavity of the laser such that the by-products of the laser are evacuated therefrom within less than 1.0 second to allow for efficient continuous wave laser operation. An optical cavity is an elongated region comprised of a mirror at each end, and allows most of the laser photons to be stimulated in a specific direction, such that a rapidly growing beam resonates between the mirrors.

The mass flow ratio of the motive fluid in the ejector of the laser to the gaseous effluent being withdrawn from the optical cavity is at least 5:1. In contrast to the prior art evacuation method in which $O_2$ is a combustion product following the decomposition of hydrogen peroxide by means of catalytic conversion, causing thermal choking within the ejector and reducing performance, it would be appreciated that the present invention allows for the evacuation of the laser by-products without any thermal choking since $CO_2$ is the only combustion product in addition to the superheated steam. $CO_2$ does not react with the laser by-products, and therefore no thermal choking will result.

Example II

A desired mass flow rate of superheated steam within the ejector and of the withdrawn gaseous effluent from the optical cavity may be realized with a reduced mass flow rate of hydrogen pervade by adding cold feedwater to the generated superheated steam. The feedwater is evaporated within the flow of the superheated steam, and the high energy content of the superheated steam may therefore be utilized. For example, if superheated steam is generated at a temperature of 1200° C. and at a flow rate of 10 kg/s, and if feedwater having a temperature of 25° C. is added at a flow rate of 10 kg/s to the superheated steam, a second stage of superheated steam at a temperature of about 500° C. is produced and gaseous effluent is withdrawn from the optical cavity at a rate of about 6 kg/s. The feedwater may be injected by means of an atomizer (not shown) formed in vortex chamber 18, downstream from combustion zone 46, i.e. between flame holder 20 and exit nozzle 40, after the combustion is self-sustaining. Alternatively, the feedwater may be added to the superheated steam after being discharged from exit nozzle 40. It would be appreciated that this method is especially practical in those situations in which water is used to cool the laser, and instead of draining this cooling water it may be reused to generate superheated steam.

As well known, the cost and profitability of a process plant are dependent upon a material component, a labor component and an overhead component. A major factor in determining the material coat is the installed cost of process equipment.

To effect the desired output of a process using the method of the present invention, namely superheated steam at a predetermined flow rate, hydrogen peroxide and ethylene have to be injected into the combustion chamber at a predetermined pressure, temperature and flow rate. The cost of the process may be lowered by reducing the installed cost of process equipment without significantly reducing the output of superheated steam. By reducing the pressure of the superheated steam, the weight and size of the containment vessels storing the gas, in addition to the rating of the pumps delivering the compressed gas to the combustion chamber at a predetermined flow rate, may be reduced. The minimal pressure of the superheated steam is limited by the saturation point; for a given temperature the pressure of the superheated steam must be greater than a certain value to prevent condensation of the steam at the exit nozzle. Reduction of the size and weight of the equipment is particularly important for mobile and transportable systems. In prior art systems in which hydrogen peroxide is used as a monopropellant without being combustible with an external fuel, the generated superheated steam temperature is relatively low, and therefore a higher steam pressure is required. For example, if a hydrogen peroxide solution having a concentration of 70% is used with a prior art system, the minimal steam temperature is approximately 500° K. and the minimally allowed pressure is about 3 MPa. However, if the method of the present invention is employed by which the decomposition product of hydrogen peroxide is burned and a temperature of 700° K. of the combustion gases is achieved by controlling the amount of fuel injected into the combustion chamber or by adding feedwater, the superheated steam pressure can be as low as 1.6 MPa. The pressure of the motive fluid of an ejector does not have significant effect on the flow ratio of the motive fluid to the laser effluent, and there are therefore not any noticeable disadvantages to reducing the pressure of the superheated steam.

Other examples may be envisioned with the use of gaseous fuels such as hydrogen, propane, acetylene and other hydrocarbon gases.

Other examples may be envisioned with the use of a liquid fuel instead of the gaseous ethylene, such as alcohol, benzene, diesel oil or petroleum.

While some embodiments of the invention have been described by way of illustration, it will be apparent that the invention can be carried into practice with many modifications, variations and adaptations, and with the use of numerous equivalents or alternative solutions that are within the scope of persons skilled in the art, without departing from the spirit of the invention or exceeding the scope of the claims.

What is claimed is:

1. A method for generating superheated steam from industrial grade hydrogen peroxide, comprising the steps of:

providing a combustion chamber in which a flame holder is mounted and divides the same into a first and second part;

injecting hydrogen peroxide and a combustible fluid into said first part of the combustion chamber to form a reactant mixture;

igniting a pilot flame whereby decomposition of hydrogen peroxide is initiated; and allowing the pilot flame to propagate to said flame holder whereby to form hot spots thereon, thereby increasing the rate of hydrogen peroxide decomposition and initiating the ignition of said reactant mixture, whereby to produce combustion gases and to generate superheated steam.

2. The method of claim 1, further comprising the step of allowing generated superheated steam to exit from said second part of the combustion chamber while inducing vortices in said second part of the combustion chamber.

3. The method of claim 1, wherein hydrogen peroxide and the combustible fluid are injected into the combustion chamber only when the pilot flame is lit.

4. The method of claim 3, wherein hydrogen peroxide and the combustible fluid are injected into the combustion chamber 1.0–2.0 sec after the pilot flame is lit.

5. The method of claim 1, wherein the pilot flame is in contact with said reactant mixture until a reactant mixture temperature of 1200° C. is achieved.

6. The method of claim 5, wherein the pilot flame is extinguished after the combustion is self-sustaining.

7. The method of claim 1, wherein the pilot flame is lit by means of a spark plug.

8. The method of claim 1, wherein tho ratio of the combustible fluid to hydrogen peroxide is 1:20 for a concentration of hydrogen peroxide solution of 49%.

9. The method of claim 1, wherein said combustible fluid is ethylene.

10. The method of claim 1, wherein vortices are induced by the flame holder, thereby increasing combustion efficiency.

11. The method of claim 1, wherein superheated steam is having a temperature of about 1200° C. and a pressure of about 1.5 MPa is released from the combustion chamber at a velocity of about 1500 m/s.

12. The method of claim 11, wherein the superheated steam is released at least 2.25 seconds after the pilot flame is lit.

13. The method of claim 1, wherein the concentration of hydrogen peroxide solution is between 49% and 70%.

14. The method of claim 1, wherein the hydrogen peroxide contains no less than 200 mg/liter of stabilizers.

15. The method of claim 1, wherein the temperature, pressure and flow rate of the generated superheated steam are controllable.

16. The method of claim 1, further comprising the step of increasing the flow rate of the steam by adding feedwater to the generated superheated steam after the combustion is self-sustaining.

17. The method of claim 16, wherein the feedwater is added to the generated superheated steam via an atomizer formed in the combustion.

18. The method of claim 16, wherein the feedwater is added to the generated superheated steam downstream of the combustion chamber.

19. A method of withdrawing the gaseous effluent of a chemical laser from its optical cavity in accordance with the method of claim 1, wherein the generated superheated steam is the motive fluid of an ejector, said ejector inducing a vacuum in the vicinity of the optical cavity whereby to release the gaseous effluent.

20. The method of claim 19, wherein the gaseous effluent is withdrawn from the optical cavity within less than 1.0 second.

21. Tho method of claim 19, wherein the mass flow ratio of the motive fluid in the ejector to the gaseous effluent being withdrawn from the optical cavity is at least 5:1.

22. An apparatus for generating superheated steam, comprising:

a) a combustion chamber;

b) a flame holder mounted within the combustion chamber and dividing the same into a first and second part;

c) a first shutoff valve for the injection of hydrogen peroxide into said first part of said combustion chamber;

d) a second shutoff valve for the injection of a combustible fluid into said first part of said combustion chamber;

e) a means for the ignition of a pilot flame; and f) an exit nozzle for the release of the generated superheated steam from said second part of said combustion chamber.

23. The apparatus of claim 22, further comprising a first controller and a second controller fir controlling the pressure and flow rate of hydrogen peroxide and the combustible fluid, respectively.

24. The apparatus of claim 23, wherein the first and second controllers ensure that the pressure and flow rate of the hydrogen peroxide and the combustible fluid, respectively, do not deviate more than 15% from the predetermined values.

25. The apparatus of claim 22, wherein the ratio between the width of the flame holder and the length of the combustion chamber is in the range of 1:10 to 1:5.

26. The apparatus of claim 22, wherein the combustion chamber is essentially cylindrical.

27. The apparatus of claim 22, wherein the first shutoff valve injects hydrogen peroxide solution having a concentration of at least 49%.

28. The apparatus of claim 27, wherein the first shutoff valve injects hydrogen peroxide solution having a concentration of between 49% and 70%.

29. The apparatus of claim 22, wherein the flame holder is permeable to combustion gases and is made of a material which is fire resistant and capable of producing hot spots, said flame holder being provided with such a structure so as to induce vortices within the combustion gases at the second part of the combustion chamber.

30. The apparatus of claim 29, wherein the flame holder is a ring interposed between two screens.

31. The apparatus of claim 30, wherein the ratio between the inner diameter of the flame holder ring and combustion chamber is 1:1 to 1:3.

32. The apparatus of claim 22, further comprising a pilot chamber for the formation of a pilot flame therein.

33. The apparatus of claim 32, wherein a supply of ethylene and oxygen is fed to the pilot chamber.

34. The apparatus of claim 22, wherein the means for igniting the pilot flame is a spark plug.

35. The apparatus of claim 22, further comprising a flame detection apparatus.

36. The apparatus of claim 35, wherein the first and the second shutoff valves close if the flame detection apparatus detects that the pilot flame is not lit.

37. The apparatus of claim 22, further comprising a atomizer formed in the second part of the combustion chamber for the injection of feedwater therethrough, whereby to increase the flow rate of the steam produced in the apparatus.

* * * * *